US006523343B2

(12) United States Patent
Dürr et al.

(10) Patent No.: US 6,523,343 B2
(45) Date of Patent: Feb. 25, 2003

(54) AIR GAP INSULATED EXHAUST MANIFOLD ASSEMBLY FOR AN INTERNAL COMBUSTION ENGINE AND A METHOD OF MAKING SAME

(75) Inventors: Gerd Dürr, Neustadt-Hambach (DE); Johann Krämer, Leonberg (DE); Martin Schlegl, Kernen (DE); Gerd Tiefenbacher, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/985,170

(22) Filed: Nov. 1, 2001

(65) Prior Publication Data

US 2002/0059795 A1 May 23, 2002

(30) Foreign Application Priority Data

Nov. 1, 2000 (DE) ..... 100 54 006

(51) Int. Cl.[7] ..... F01N 7/10
(52) U.S. Cl. ..... 60/323; 60/322; 60/321
(58) Field of Search ..... 60/323, 322

(56) References Cited

U.S. PATENT DOCUMENTS

| | | | | | |
|---|---|---|---|---|---|
| 4,074,524 | A | * | 2/1978 | Ikeya | 60/322 |
| 5,331,810 | A | * | 7/1994 | Ingermann et al. | 60/272 |
| 5,572,867 | A | * | 11/1996 | Bekkering et al. | 60/305 |
| 5,682,741 | A | * | 11/1997 | Augustin et al. | 285/125.1 |
| 5,761,905 | A | * | 6/1998 | Yamada et al. | 60/322 |
| 5,765,878 | A | * | 6/1998 | Bonny et al. | 285/123.1 |
| 5,899,063 | A | * | 5/1999 | Leistritz | 422/173 |
| 6,155,046 | A | * | 12/2000 | Kato et al. | 60/322 |
| 6,199,376 | B1 | * | 3/2001 | Maeda | 60/313 |
| 6,327,854 | B1 | * | 12/2001 | Bonny et al. | 60/321 |

FOREIGN PATENT DOCUMENTS

| | | | | |
|---|---|---|---|---|
| CA | 634616 | * | 1/1962 | 60/323 |
| DE | 139282 | * | 6/1930 | |
| DE | 3005813 | * | 9/1981 | |
| DE | 3333591 | * | 3/1985 | 60/323 |
| DE | 196 28 797 | | 1/1988 | |
| JP | 0244816 | * | 10/1986 | 60/323 |
| JP | 363215809 | * | 9/1988 | |
| JP | 06137144 | * | 5/1994 | |
| JP | 06346728 | * | 12/1994 | |
| JP | 08-021233 | * | 1/1996 | |
| JP | 08-338240 | * | 12/1996 | |
| JP | 410266845 | * | 10/1998 | |
| JP | 2000-248931 | * | 9/2000 | |
| WO | WO094009267 | * | 4/1994 | |

* cited by examiner

*Primary Examiner*—Thomas Denion
*Assistant Examiner*—Diem Tran
(74) *Attorney, Agent, or Firm*—Crowell & Moring LLP

(57) ABSTRACT

An air gap insulated exhaust manifold for an internal combustion engine of a motor vehicle that has a catalytic converter. The exhaust manifold includes an inner pipe and an outer pipe with a connecting flange on the cylinder head side of the outer pipe. The outer pipe encloses the inner pipe and is spaced therefrom at a distance. A pipe end of the inner pipe protrudes in a guided manner into the cylinder head and only the outer pipe is fastenable to the cylinder head by way of the

19 Claims, 1 Drawing Sheet

AIR GAP INSULATED EXHAUST MANIFOLD ASSEMBLY FOR AN INTERNAL COMBUSTION ENGINE AND A METHOD OF MAKING SAME connecting flange.

BACKGROUND AND SUMMARY OF THE INVENTION

This application claims the priority of German Patent Document DE 100 54 006.6, filed in Germany on Nov. 1, 2000, the disclosure of which is expressly incorporated by reference herein.

The invention relates to an air gap insulated exhaust manifold for an internal combustion engine of a motor vehicle having a catalytic converter. The air gap insulated exhaust manifold includes an inner pipe and an outer pipe surrounding the inner pipe at a defined distance with a connecting flange on the side of the cylinder head.

German Patent Document DE 196 28 797 C1 discloses an air gap insulated exhaust manifold having an inner pipe which is surrounded by an outer pipe at a distance.

Air gap insulated exhaust manifolds are widely used in practice because relatively little thermal energy is released to the surroundings from the exhaust gas due to the insulating air gap. For quick catalytic converter heating, it is beneficial if the exhaust gas releases little thermal energy.

Similar embodiments of air gap insulated exhaust manifolds contain a fastening flange to the cylinder head, to which the exhaust pipes are fastened. The exhaust pipes lead from the manifold to the exhaust collecting pipe. Air gap insulation through an outer metal shell starts close to the connecting flange, however the exhaust pipe is not insulated directly on the connecting flange, but rather firmly connected.

This has the disadvantage that in the area of the connecting flange heat transmission to the surroundings occurs.

The invention is based on the goal of fastening an air gap insulated exhaust manifold having an outer pipe and an inner pipe to the cylinder head of an internal combustion engine in an optimal way.

At least this goal is achieved by arranging the inner pipe such that it protrudes into the cylinder head with its pipe end in a guided fashion and that only the outer pipe can be fastened to the cylinder head through a connecting flange.

Motor vehicles with internal combustion engines are equipped with catalytic converters so as to reduce the amount of pollutants in the exhaust gas. Conventional catalytic converters work only within a certain temperature range. In the case of low exhaust gas temperatures, the catalytic effect does not occur. In the case of high temperatures, the catalytic converter is destroyed. In order to achieve prompt starting of the catalytic converter, it is important that as little thermal energy as possible is lost between the combustion chamber in the cylinder head and the catalytic converter.

The distance between the cylinder head and the catalytic converter is bridged by the exhaust manifold, which is generally screwed to the cylinder head. The exhaust manifold has a connecting pipe for each cylinder, which joins into a common collecting pipe. The collecting pipe extends away from the cylinder head area and joins into the catalytic converter.

Good thermal insulation is accomplished by designing the exhaust manifolds with double walls, with an insulating air gap between the inner pipe and the outer pipe. The inner pipe is usually welded from several pipe sections. The outer pipe is formed by several preformed metal shells, which are joined, placed around the inner pipe and kept at a distance to the inner pipe with specialized spacers.

In the cylinder head, the exhaust port can be insulated with a so-called port liner. Such a solution, however, is complex.

It is advantageous when no or few heat bridges exist from the hot exhaust gas to the surroundings of the exhaust pipe between the exhaust port in the cylinder head and the end of the exhaust manifold on the catalytic converter side.

In a preferred embodiment of the cylinder head and the exhaust manifold, this requirement is fulfilled with the fact that the exhaust gas port contains an insulating air gap from the inside of the cylinder head to the end of the exhaust manifold on the catalytic converter side, without containing a heat bridge in the area of the cylinder head flange of the exhaust manifold.

The outer pipe of the exhaust manifold is fastened to the cylinder head with a continuous or with several individual flanges on the cylinder head. In order to better insulate against noise transmission, it is beneficial if a specialized spacer is arranged between the connecting flange and the cylinder head.

Since the outer pipe serves as a supporting pipe for the inner pipe, and does not come into contact with the hot exhaust gas but only with the air layer in the air gap insulation, it is not absolutely necessary to fasten the flange of the outer pipe to the cylinder head in a gas-tight manner. This opens up a multitude of opportunities for fastening the flange with specialized spacers to the cylinder head in such a way that no or little motor vibration is transmitted to the exhaust pipe. Since the insulating air gap encloses the inner pipe all the way into the cylinder head, large amounts of heat are not applied to the flange by the hot exhaust gas in the flange area, permitting also materials that are not heat-resistant to be used as specialized spacers.

Apart from the catalytic converter side end, the outer pipe is connected with the inner pipe only by support elements. These support elements have designs as they do in conventional air gap insulated exhaust manifolds, such as simple sheet metal parts that keep the inner pipe at a distance from the outer pipe, but at the same time permit minimal movement in the pipe direction caused by differences in thermal expansion.

Hot exhaust gas flows through the inner pipe, and the outer pipe is separated from it by an air gap and exposed to the cooler surrounding air. This results in considerable temperature differences between the two pipes. In order to prevent the pipes from deforming due to thermal expansion within the exhaust manifold, it is necessary to allow the inner pipe to be moved within the outer pipe.

Referring again to German Patent Document DE 196 28 797 C1, the inner and outer pipes are united on the catalytic converter side end of the exhaust manifold on a flange with simple insulation and connected in a conventional manner with the catalytic converter.

Here, as well, improved thermal insulation is achieved in a manner similar to the one on the cylinder head side end of the exhaust manifold. This means that the outer pipe of the exhaust manifold is connected with the catalytic converter housing e.g. through a conventional flange, and that the inner pipe protrudes into the catalytic converter housing beyond the flange area. In order to accomplish this, the inner pipe is held at a distance to the outer pipe, the flange and the catalytic converter intake across its entire length by way of specialized spacers.

The inner pipe protrudes into the exhaust port of the cylinder head as far as possible. For simple assembly of the exhaust manifold to the cylinder head, it is beneficial if the pipe section of the inner pipe that protrudes into the cylinder head is substantially straight. This means that the inner pipe protrudes into the cylinder head along a length equal to that of the exhaust port, with no or only a small bend.

The inner pipe has a continuous cross-section to the exhaust port section that is located downstream in front of it. In order to avoid an abrupt change of the cross-section in the transition from the exhaust port to the inner pipe of the exhaust manifold, the exhaust port exhibits a port expansion in the cylinder head, into which the inner pipe is slid from the cylinder head flange. The port expansion has such a design that an insulating air gap is created between the inner pipe and the expanded port.

The sealing elements that keep the inner pipe in the cylinder head and simultaneously seal it can be made of various materials, such as thermoplastic, rubber with high temperature stability or a metallic material. Fastening of the synthetic sealing elements occurs in a fashion similar to that of an O-ring.

Other objects, advantages and novel features of the present invention will become apparent from the following detailed description of the invention when considered in conjunction with the accompanying drawings.

DETAILED DESCRIPTION OF THE DRAWINGS

Figure 1:
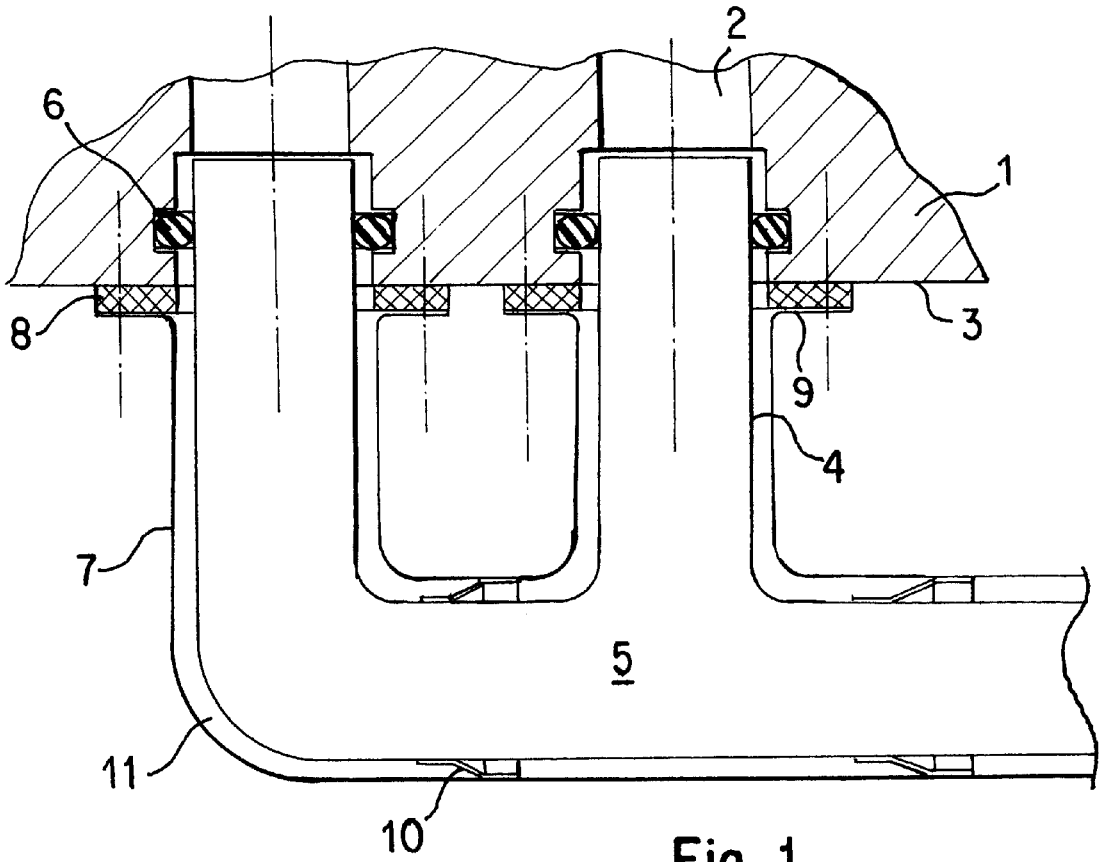
FIG. 1 shows a section of an air gap insulated exhaust manifold whose inner pipe protrudes into the cylinder head.

A cylinder head 1 in FIG. 1 of an internal combustion engine, not shown in detail, contains at least one exhaust port 2 and a flange area 3. In the area of its port end, the exhaust port 2 is broader toward the flange area 3. The inner pipe 4 of an air gap insulated exhaust manifold 5 is located in the expanded exhaust port 2 and is set in its position and sealed against the surroundings by sealing elements 6.

The outer pipe 7 of the exhaust manifold 5 is screwed to the flange area 3 of the cylinder head 1 with specialized spacers 8. These specialized spacers 8 consist e.g. of metal, rubber or synthetic and are pressed in between the flange 9 of the outer pipe 7 and the flange area 3 of the cylinder head 1 so that the outer pipe is fastened to the cylinder head on one hand and that the outer pipe is decoupled acoustically and thermally from the cylinder head on the other hand.

The flange 9 can be designed as an individual part for each individual cylinder, and/or for each individual exhaust port 2, in order to enable better compensation of the different thermal expansions of the connecting flange and the cylinder head 1. Alternatively, if a screw assembly of the exhaust manifold 5 with the cylinder head 1 with fewer screws is desired, one continuous flange 9 for all of the cylinders or exhaust parts can be provided.

The outer pipe 7 supports the inner pipe 4 with specialized spacers 10, which due to their pure support function are designed as simple metal fasteners and are mounted e.g. to the outer pipe during the initial assembly of the exhaust manifold 9 and hold the inner pipe in place while allowing some movement. When selecting the points of separation appropriately between the individual sections of the outer pipe 7, it is easy to mold the specialized spacers 10 when producing the individual sections.

In order to compensate different degrees of thermal expansion between the inner pipe 4 and the outer pipe 7 due to differing temperatures, the inner pipe can slide within the outer pipe. Specialized spacers 10 in the design of sliding seats accomplish this function.

The sealing elements 6 between the inner pipe 4 and the cylinder head 1 consist of synthetic, rubber with high temperature stability or metal. Non-metallic sealing elements 6 are seated like O-rings in the cylinder head 1, as shown, offer a sealing function to the inner pipe from the cylinder head 1, and dampen the transmission of vibrations.

Alternatively, metallic sealing elements 6 can also be used, whose sealing function is based on the piston ring principle or are pressed directly between the inner pipe 4 and the cylinder head 1, but have little noise dampening.

Due the gas-tight design of the sealing elements 6 and the inner pipes 4, air with ambient pressure exists in the air gap 11 between the inner pipe and outer pipe 7, but no exhaust gas. The outer pipe 7 supports the inner pipe 4 and prevents air movement in the air gap 11, which would impair thermal insulation of the still air.

Figure 2:
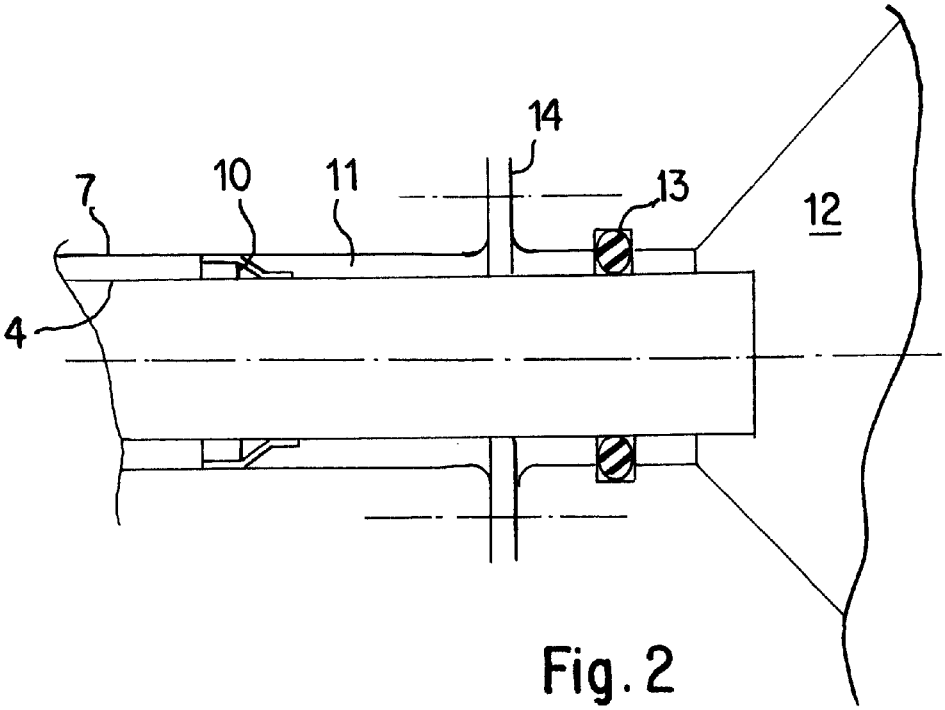
FIG. 2 shows an end section of an air gap insulated exhaust manifold with the transition into the intake of the catalytic converter housing.

FIG. 2 shows the transition from the exhaust manifold 5 to the catalytic converter housing 12, which functions basically the same as the transition into the cylinder head 1. Since the inner pipe 4 joins-freely into the catalytic converter housing 12, the gas-tight connection is created with sealing elements 13 from the inner pipe 4 to the catalytic converter housing in an appropriate location, at which the catalytic converter housing has not widened too much yet. The sealing elements 13 are basically the same as those described for the transition from the cylinder head 1 to the inner pipe 4. The outer pipe 7 is connected with the catalytic converter housing 13 in the conventional manner, e.g. connection of two connecting flanges 14.

The foregoing disclosure has been set forth merely to illustrate the invention and is not intended to be limiting.

Since modifications of the disclosed embodiments incorporating the spirit and substance of the invention may occur to persons skilled in the art, the invention should be construed to include everything within the scope of the appended claims and equivalents thereof.

What is claimed is:

1. Air gap insulated exhaust manifold for an internal combustion engine of a motor vehicle that contains a catalytic converter, comprising:

an inner pipe and an outer pipe with a connecting flange on a cylinder head side of the exhaust manifold, the outer pipe enclosing the inner pipe while being spaced therefrom at a distance to form an air gap therebetween, wherein the inner pipe protrudes in use into a cylinder head with a pipe end in a guided manner and wherein the outer pipe is fastenable to the cylinder head with the connecting flange such that the air gap encloses the inner pipe through the connecting flange.

2. Air gap insulated exhaust manifold according to claim 1, wherein a specialized spacer is arranged between the connecting flange and the cylinder head.

3. Air gap insulated exhaust manifold according to claim 1, wherein the cylinder head comprises a plurality of exhaust ports, each exhaust port having a port expansion with at least one sealing element being arranged in a secure position between the port expansion and the inner pipe.

4. Air gap insulated exhaust manifold according to claim 1, wherein the connecting flange is continuous for all cylinders or exhaust ports of the cylinder head.

5. Air gap insulated exhaust manifold according to claim 1, wherein the connecting flange is separate for each cylinder of the cylinder head.

6. Air gap insulated exhaust manifold according to claim 1, wherein a catalytic converter side pipe end of the inner pipe protrudes into a housing of the catalytic converter such that only the outer pipe is fastenable to the catalytic converter housing by way of a connecting flange.

7. An air gap insulated exhaust manifold assembly for an engine having a catalytic converter comprising:

an inner pipe having a cylinder head pipe end side; and an outer pipe comprising a connecting flange arranged on a cylinder head pipe end side of the outer pipe, the outer pipe being arranged to surround the inner pipe while being spaced therefrom at a distance to thereby form an air gap;

wherein the cylinder head pipe end side of the inner pipe extends beyond the connecting flange of the outer pipe and is inserted in a guided manner into a cylinder head such that the outer pipe is fastened to the cylinder head by way of the connecting flange such that the air gap encloses the inner pipe through the connecting flange.

8. An air gap insulated exhaust manifold assembly according to claim 7, wherein only the outer pipe is fastened to the cylinder head by way of the connecting flange.

9. An air gap insulated exhaust manifold assembly according to claim 7, wherein a specialized spacer is arranged between the connecting flange and the cylinder head.

10. An air gap insulated exhaust manifold assembly according to claim 7, wherein the cylinder head comprises a plurality of exhaust ports each having a port expansion portion, at least one sealing element being arranged between the port expansion portion and the inner pipe to securely hold the inner pipe.

11. An air gap insulated exhaust manifold assembly according to claim 7, wherein the connecting flange is a continuous flange which operatively connects the outer pipe to all exhaust ports or cylinders of the cylinder head.

12. An air gap insulated exhaust manifold assembly according to claim 7, wherein the connecting flange forms a separate structure for each exhaust port or cylinder of the cylinder head.

13. An air gap insulated exhaust manifold assembly according to claim 7, wherein a catalytic converter pipe end of the inner pipe is inserted in a catalytic converter housing and the outer pipe is fastened to the catalytic converter housing by way of a catalytic converter connecting flange.

14. An air gap insulated exhaust manifold assembly according to claim 13, wherein only the outer pipe is fastened to the catalytic converter housing by way of the catalytic converter connecting flange.

15. A method of making an air gap insulated exhaust manifold assembly for an engine having a catalytic converter comprising:

providing an inner pipe having a cylinder head pipe end side;

providing an outer pipe comprising a connecting flange arranged on a cylinder head pipe end side of the outer pipe;

arranging the outer pipe such that it surrounds the inner pipe while being spaced therefrom at a distance to form an air gap therebetween;

arranging the cylinder head pipe end side of the inner pipe to extend beyond the connecting flange of the outer pipe;

inserting the cylinder head pipe end side of the inner pipe into a cylinder head; and fastening the outer pipe to the cylinder head by way of the connecting flange such that the air gap encloses the inner pipe through the connecting flange.

16. The method of claim 15 further comprising arranging a specialized spacer between the connecting flange and the cylinder head.

17. The method of claim 15 further comprising arranging a sealing element within the cylinder head between a wall of the cylinder head and the cylinder head pipe end side of the inner pipe.

18. The method of claim 15 further comprising inserting a catalytic converter pipe end side of the inner pipe in a catalytic converter housing and fastening the outer pipe to the catalytic converter housing by way of a catalytic converter connecting flange.

19. The method of claim 18 further comprising arranging a sealing element within the catalytic converter housing between a wall of the catalytic converter housing and the catalytic converter pipe end side of the inner pipe.

* * * * *